US005383500A

United States Patent [19]

Dwars et al.

[11] Patent Number: 5,383,500

[45] Date of Patent: Jan. 24, 1995

[54] AUTOMATIC REFUELLING SYSTEM

[75] Inventors: Sicco Dwars; Cornelis van Ouwerkerk; Caspar Verhaagen, all of Amsterdam, Netherlands

[73] Assignee: Shell Oil Company, Houston, Tex.

[21] Appl. No.: 27,978

[22] Filed: Mar. 8, 1993

[30] Foreign Application Priority Data

Mar. 19, 1992 [EP] European Pat. Off. ..... 92200800

[51] Int. Cl.[6] ..... B67D 5/00

[52] U.S. Cl. ..... 141/98; 141/94; 141/231; 141/192; 141/311 R; 901/6; 901/16; 901/46; 364/465; 364/479; 340/825.69; 340/825.72

[58] Field of Search ..... 340/825.69, 825.72; 364/465, 479; 235/384, 454–456; 141/1, 94, 95, 98, 192, 198, 231, 311 R, 387, 388; 901/6, 16, 27, 46, 47, 50; 137/234.6

[56] References Cited

U.S. PATENT DOCUMENTS

| | | | |
|---|---|---|---|
| 3,364,940 | 1/1968 | Ginsburgh et al. | 137/234.6 |
| 3,391,651 | 7/1968 | Ginsburgh et al. . | |
| 3,410,320 | 11/1968 | Ginsburgh et al. | 141/98 |
| 3,502,117 | 3/1970 | Nebelsiek et al. | 141/7 |
| 3,527,268 | 9/1970 | Ginsburgh | 141/98 |
| 3,530,906 | 9/1970 | Ginsburgh et al. | 141/59 |
| 3,580,414 | 5/1971 | Ginsburgh et al. . | |
| 3,642,036 | 2/1972 | Ginsburgh et al. | 141/94 |
| 3,650,303 | 3/1972 | Chambers et al. | 141/1 |
| 3,814,148 | 6/1974 | Wostl | 141/98 |
| 4,263,945 | 4/1981 | Van Ness | 141/98 |
| 4,303,904 | 12/1981 | Chasek . | |
| 4,338,587 | 7/1982 | Chiappetti . | |
| 4,345,146 | 8/1982 | Story et al. | 235/381 |
| 4,469,149 | 9/1984 | Walkey et al. | 141/94 |
| 4,532,511 | 7/1985 | Lemelson . | |
| 4,665,955 | 5/1987 | Horvath et al. | 141/1 |
| 4,681,144 | 7/1987 | Horvath et al. | 141/1 |
| 4,708,175 | 11/1987 | Janashak et al. | 141/1 |
| 4,712,709 | 12/1987 | Horvath et al. | 220/334 |
| 4,817,166 | 3/1989 | Gonzalez et al. | 382/1 |
| 4,846,233 | 7/1989 | Fockens | 141/94 |
| 4,881,581 | 11/1989 | Hollerback | 141/113 |
| 4,908,500 | 3/1990 | Baumberger | 235/384 |
| 4,934,419 | 6/1990 | Lamont et al. | 141/94 |
| 5,109,222 | 4/1992 | Welty | 340/825.72 |
| 5,156,198 | 10/1992 | Hall | 141/94 |
| 5,204,819 | 4/1993 | Ryan | 364/465 |
| 5,227,780 | 7/1993 | Tigwell | 340/825.72 |
| 5,238,034 | 8/1993 | Corfitsen | 141/94 |

FOREIGN PATENT DOCUMENTS

| | | | |
|---|---|---|---|
| 0002518B1 | 11/1981 | European Pat. Off. . | |
| 0235678A1 | 9/1987 | European Pat. Off. . | |
| 0312010A2 | 4/1989 | European Pat. Off. . | |
| 0330165A2 | 8/1989 | European Pat. Off. . | |
| 418744-A | 3/1991 | European Pat. Off. | 141/231 |
| 2454663 | 11/1980 | France . | |
| 2600318 | 12/1987 | France | 141/192 |
| 2843723A1 | 4/1980 | Germany . | |
| 2929192A1 | 4/1981 | Germany . | |
| 3507707A1 | 9/1986 | Germany . | |
| 62-087-947-A | 4/1987 | Japan . | |
| 63-044-292-A | 2/1988 | Japan . | |
| 63-043-405-A | 2/1988 | Japan . | |
| 3000698 | 1/1991 | Japan | 141/94 |
| 4024153 | 1/1992 | Japan | 141/192 |
| 4057789 | 2/1992 | Japan | 141/192 |
| 78/1481 | 4/1979 | South Africa . | |
| 88/5097 | 7/1988 | South Africa . | |
| 666566A5 | 7/1988 | Switzerland . | |
| 669687A5 | 3/1989 | Switzerland . | |
| 2089083A | 6/1982 | United Kingdom . | |
| 2154832A | 9/1985 | United Kingdom . | |
| 2186409 A | 8/1987 | United Kingdom . | |

*Primary Examiner*—J. Casimer Jacyna

*Attorney, Agent, or Firm*—Fred S. Reynolds

[57] ABSTRACT

A system for control of automatic refueling of automotive vehicles parked alongside a fuel dispenser unit which allows for a customer to control a refueling procedure without having to exit the vehicle. The control system includes a processing unit, control operating units, operating units and a communications system which is located within the vehicle to be refueled. The communications system has the capability to start, monitor and finish the refueling procedure by transmitting and receiving data signals which concern the refueling procedure such as signals which start the refueling procedure and signals which interrupt the procedure. The data signals are received by the from the vehicle into the processing unit where the signals are processed. The processed data signals are directed to control operating units. The control operating units then direct operating units in carrying out operating functions which are necessary to automatically refuel the vehicle.

16 Claims, 2 Drawing Sheets

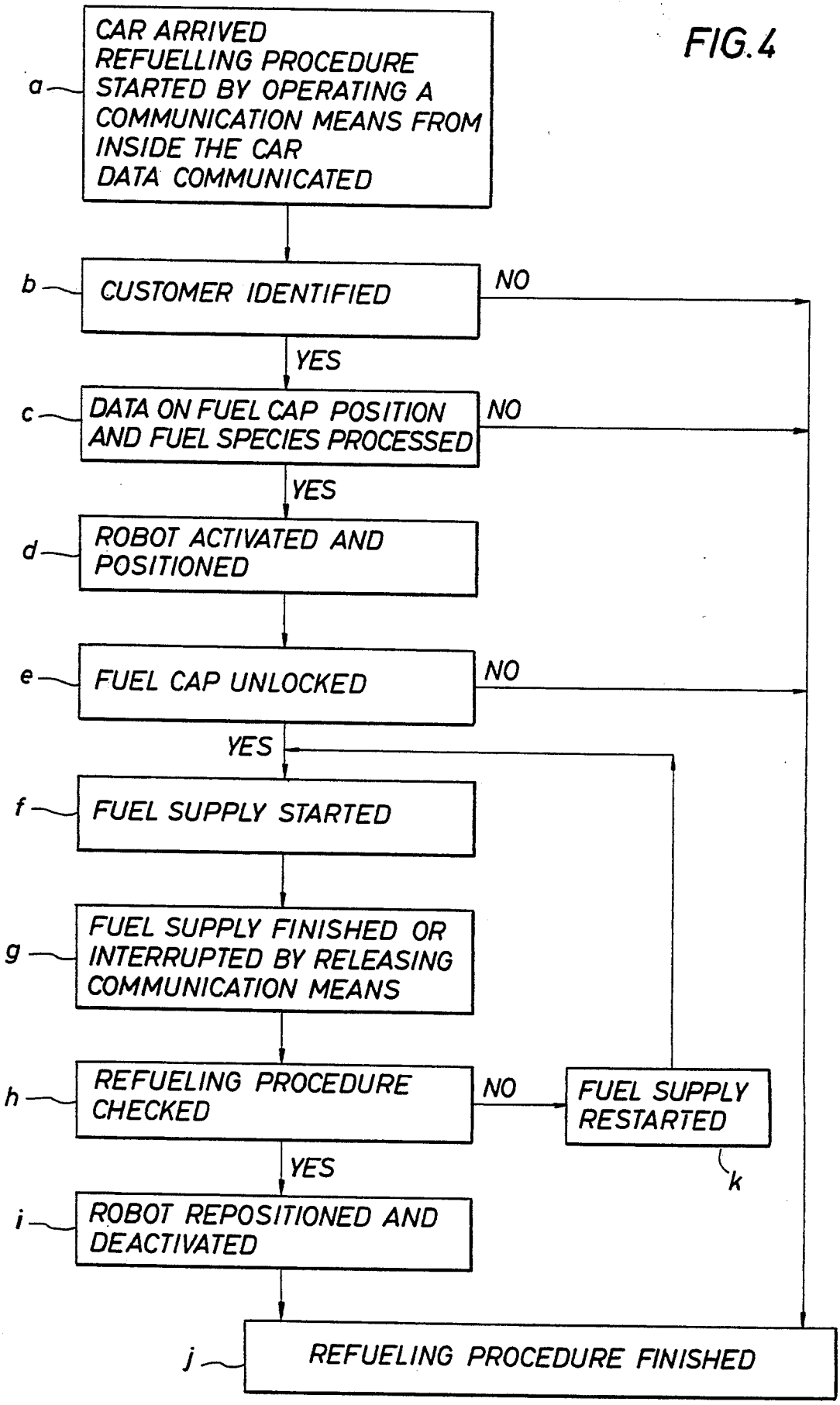
FIG. 4
a
CAR ARRIVED
REFUELLING PROCEDURE
STARTED BY OPERATING A
COMMUNICATION MEANS FROM
INSIDE THE CAR
DATA COMMUNICATED
b
CUSTOMER IDENTIFIED
NO
YES
c
DATA ON FUEL CAP POSITION
AND FUEL SPECIES PROCESSED
NO
YES
d
ROBOT ACTIVATED AND
POSITIONED
e
FUEL CAP UNLOCKED
NO
YES
f
FUEL SUPPLY STARTED
g
FUEL SUPPLY FINISHED OR
INTERRUPTED BY RELEASING
COMMUNICATION MEANS
h
REFUELING PROCEDURE
CHECKED
NO
FUEL SUPPLY
RESTARTED
k
YES
i
ROBOT REPOSITIONED AND
DEACTIVATED
j
REFUELING PROCEDURE FINISHED

AUTOMATIC REFUELLING SYSTEM

FIELD OF THE INVENTION

The present invention relates to a system for control of automatic refuelling of automotive vehicles.

BACKGROUND OF THE INVENTION

One type of an automatic refuelling system is known from European patent application EP 418 744. The system to be controlled shows a refuelling station for parked vehicles. A refuelling operation enables stage-wise operation. In this reference a process scheme presents driver actions, unit control indications, detection steps, and operation steps, subsequently linked in order to accomplish a refuelling procedure. A service panel, separate from both the vehicle and the pump housing means and built within a console-table, is operated for data communication with a processing unit (PU). Furthermore, a near field detection device for accurately positioning a supply nozzle is included to further enable a clean fuel supply, also including fuel vapor return means.

Although in the above discussed disclosure an advanced automatic refuelling system is presented in that the driver or customer yet maintains full control as to the fuelling procedure, some shortcomings remain. Panel handling, including the supply of a credit card, outside the vehicle is always required. In view of the customer's or client's convenience as to safety, possible physical handicap, and state of the weather, the way of operating shown in the disclosure is not desirable since the customer must leave the vehicle.

Besides the safety aspects mentioned a further aspect has to be noticed. Although automatic refuelling simplifies the customer's efforts and direct involvement and interference with respect to the refuelling procedure, the automation substantially reduces the customers power to correct and to interrupt the procedure. Furthermore, separate station units, arranged for operating the above console-table and pump housing filling devices, making up the refuelling station as a whole, are necessary.

As a further consequence, several data providing and data communications 1 inks are employed, thereby complicating signal communication processing. Accordingly, separate driver actions and respective detection operations need to be connected to unified data signals for being processed by the PU. Thus, separate signal pick up and signal link interruptions are possible failure sources.

Accordingly, it would be advantageous to have an automatic refuelling system which did not require the driver to exit the vehicle and which permitted the driver to interrupt or modify the refuelling if desired.

SUMMARY OF THE INVENTION

The system of the invention includes a communication means for starting, monitoring and finishing a refuelling procedure, the procedure including a starting step, a fuel supply step and a finishing step; operating control units for controlling a number of operating functions involved within the refuelling procedure, the operating functions being be carried out by respective operating units; and a processing unit (PU) for processing and communicating data signals, the data signals processed being conducted to the operating control units.

BRIEF DESCRIPTION OF THE DRAWINGS

FIG. 4 shows a flow chart of an embodiment of an operating sequence to be effected by the system of the invention.

DETAILED DESCRIPTION OF THE INVENTION

A. COMMUNICATION MEANS

In accordance with the present invention the communication means of the system for control of automatic refuelling of automotive vehicles as explained above is arranged within the vehicle to be operated by the customer. The communication means transmits and receives data signals, the data concerning the vehicle and the customer.

In a further embodiment of the invention the communication means is operated continuously thereby enabling advantageously unexpected situations, for example, as to the customer's health, to be monitored closely. Advantageously the communication means communicates refuelling procedure data, for example, as to the amount of fuel to be supplied, or the money equivalent for which fuel is desired.

In accordance with the invention the communication means is a vehicle control means. In a further embodiment of the invention the vehicle control means includes at least one pedal operated for starting, and respectively finishing, the refuelling procedure by pressing, and respectively releasing, the pedal, or at least one key of an in-car terminal. Furthermore, combinations of the above operating devices are included in the present invention.

In another embodiment, the communication means of the present invention includes an electromagnetic or acoustic wave transmitter/receiver means arranged on a vehicle and on the fuel dispenser unit. In a preferred embodiment the transmitter/receiver means are housed in a rear light unit. Preferably, infra-red (IR) light waves are employed.

In accordance with the invention the above data include first and second data signals concerning fuel fill pipe data, cap position data, fuel type data, and cap lock data, customer identification data, and customer bank account data.

The present invention will now be described in more detail by reference to the accompanying drawings which depict non-limiting embodiments of the invention. Although the following description and appending claims relate to refuelling vehicles or cars, other types of vehicles to be refuelled, refilled, or reloaded, are included. These include trucks, airplanes, ships, and trains.

Figure 1:
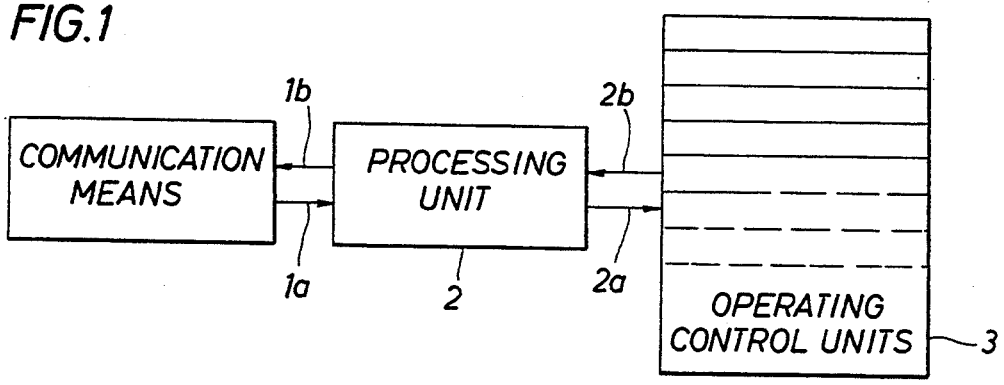
FIG. 1 shows one embodiment of a block scheme of the system of the present invention only presented in most generalized form.

In FIG. 1 a block scheme of the system of the present invention, only presented in most generalized form, is shown. A communication means 1 has signal links 1a, 1b, respectively to and from a processing unit (PU) 2, which has further communication links 2a, 2b, respectively to and from operating control units 3.

In more detail, the communication means 1 includes all the elements necessary for communication of data concerning a refuelling procedure to a PU 2. In accordance with the invention the communication means 1, which is arranged within the vehicle to be refuelled, includes an in-car operation device, or a plurality of in-car operation devices, being the only car-side communication operating means.

In an advantageous embodiment of the present invention the communication means includes a vehicle control means, for example, a vehicle pedal. While the vehicle control means is being operated, it generates an electric signal to a rear light unit which houses electronic circuitry holding data concerning the vehicle to be refuelled and the customer requiring the refuelling procedure; the circuitry is connected to a light emitting diode (LED) for transmission of infra-red light (IR) signals to at least one IR-receiver at the computer side of the links. Conventionally the electronic circuitry includes a "custom-integrated circuit", i.e. a chip which has been adapted for a specific sequence of operations. In the present case the circuitry is adapted for transmitting and receiving specifically coded data signals.

It will be clear to one skilled in the art that communication linkage can be effected also by other types of electromagnetic waves employing corresponding transmitter/receiver combinations, or even by acoustic waves, consequently necessitating suitable transmitter/-receiver devices.

B. PROCESSING UNIT

The PU 2, including well known memory units, and an arithmetic and logic unit, processes the above signals after having been converted to PU matched signals. In particular the signals are directed via links 2a, 2b to and from respective operating control units 3 including units for vehicle position determination, fill pipe and fuel cap position determination, fuel type determination, and customer or client identification. Generally PU 2 and units 3 are in one housing, for example, arranged within the main refuelling station building and functioning as a central computer. From this computer, circuitry is connected to different operating units, such as robot arm devices, fuel supply devices, and communication means as far as the computer side is involved.

In further embodiments the car-side part of the communication means includes more sophisticated operation devices such as in-car terminals including keyboard means and display means, thus capable of being employed for much more advanced use. Also combinations of the above-mentioned in-car communication means embodiments are included in the present invention.

C. OPERATING CONTROL UNITS

Figure 2:
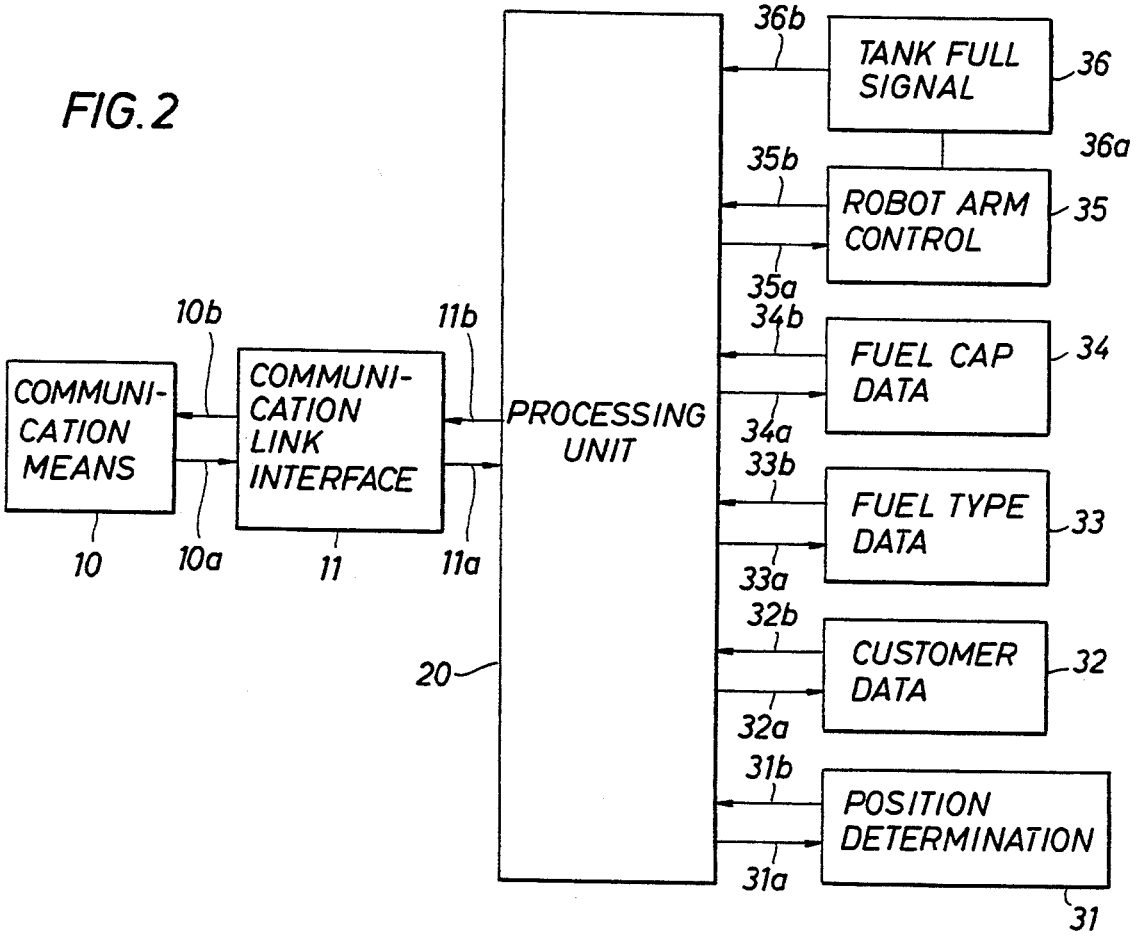
FIG. 2 shows a block scheme of the system in accordance with the present invention presenting in more detail one embodiment of the communication links between customer-operated communication means and control units for controlling fuel supply operating units.

In FIG. 2 a block scheme of the system in accordance with the invention is shown, presenting in more detail communication links between customer operated communication means and specific control units for controlling corresponding fuel supply operating units.

Analogous to FIG. 1, communication means 10, a PU 20, and operating control units 31 to 36 are shown, the control units being linked either to the PU or between each other by means of links 31a,b to 36a,b. Further to the above units a communication link interface 11 is shown, respectively linked to the communication means 10 through links 10a,b and to the PU 20 through links 11a,b.

The communication links, both as shown as to FIG. 1 and as to FIG. 2 are employed for signals including data with respect to the refuelling procedure to be carried out. In more detail, the data signals include first data signals, concerning the vehicle, for example, fill pipe and fuel cap position data, fuel type data, and cap lock data, and second data signals relating to the customer, for example, customer identification data and customer bank account data. After having been received at the computer side of the control system the data signals are processed and converted to control data signals for the above operating units, which will be explained below, for the respective data, in particular with respect to FIG. 4.

Figure 3:
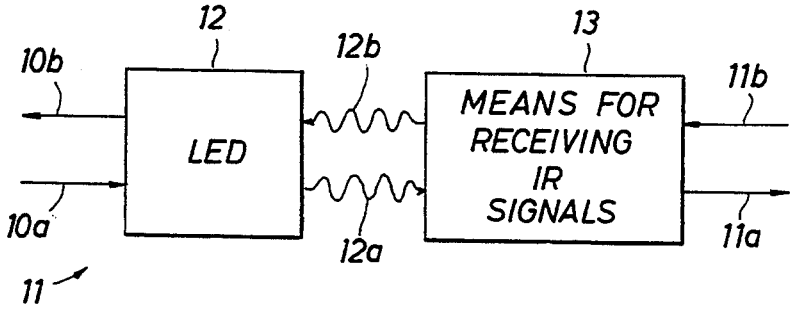
FIG. 3 shows in more detail an embodiment of the communication means in accordance with the invention.

With reference to FIG. 3 the above interface 11 is represented in more detail for an embodiment of the present invention.

1. Starting Step:

As mentioned above the customer, while in the vehicle, parks the vehicle alongside a fuel dispenser unit and requests refuelling by operating the car-side communication operating means, thereby energizing the LED arranged within the rear light unit as mentioned above, the LED being represented in FIG. 3 by reference number 12. The IR signals 12a including the first and second data, the signals being coded to a suitable form, are transmitted from the rear light and are received, for example, by an IR receiver means 13.

The IR receiver means 13 converts and forwards the first and second data signals in order to be processed in the PU 20. Both determination of the position of the rear light unit, in coded form related to the cap position, and forwarding the coded data is enabled by the IR receiver means 13.

In an advantageous embodiment of the present invention, the rear light LED 12 as such is projected upon imaging devices, in particular at least two imaging devices, in order to obtain its three-dimensional (3D) position in a suitable coordinate frame. Conveniently at least two well-known CCD (charge coupled devices) cameras are employed. Thus at least two image signals are generated.

The IR signals 12a, including the coded data, are received, converted and forwarded by means of suitable semi-conductor IR receiver devices 13 such as Si-receiver devices well known in the art. For those skilled in the art it will be clear that the devices are matched to circuitry for conducting the signals to the PU.

More in detail as to the determination of the above 3D-position the cameras mentioned watch an area nearby the fuel dispenser unit within which vehicle rear lights may be expected. The infra-red light transmitted by such rear light LED's 12 is modulated in such a way that it coincides with camera scan frequencies. An image processing system which is coupled to the cameras distinguishes the blinking IR-LED from the surroundings by using successively well-known optical filtering, image subtraction and center of gravity calculation techniques.

2. Fuel Supply Step:

In the next step the respective images, i.e. the centers of gravity, have to be combined to a 3D-position of the rear light LED 12 in a coordinate frame which includes the dispenser unit and which will be employed for the further refuelling procedure, in particular enabling a robot arm being moved to and being positioned adjacent to the fuel cap concerned.

Among the plurality of well-known position determination techniques the methods of triangulation (using the well-defined camera positions) or perspective transformation (using an image plane transfer matrix) have appeared advantageous. More in detail the transformation conventionally employs further reference points, for example, reference LED's, which are also projected.

For those skilled in the art it will be clear that in the case of employing two cameras at least one 2D-image has to be formed. As a consequence other combinations will be clear, for example, a 3D-image generated correspondingly by means of three imaging devices.

In a further advantageous embodiment of the invention, means are provided for generating gauge signals to be combined with the above image signals. For example, an additional LED on the dispenser unit will enable continuous monitoring of the operation performance of the above cameras.

In yet a further embodiment, the color and/or blinking frequency of existing visible rear light indicators are employed as the 3D position reference point or as a second reference point for car and fuel cap position measurement as explained above.

In FIG. 2 a position determination means 31 receives the above image signals 31*a* via the PU 20, and, after determination of the position, data signals generated are supplied via a signal link 31*b* to a memory unit of the PU 20 for being used in the further refuelling procedure.

The signal forms representing coded data as mentioned above are of interest as well. The data signals coded in digital form are received by well known receiver means and processed in operating control units to identify control data, bank account control data, fill pipe and fuel cap position data, cap lock control data and fuel type control data. In FIG. 2 the respective blocks represent respective processing units for obtaining the above data signals, i.e. block 32 for the customer relating data, block 33 for the fuel type data and block 34 for cap relating data.

More in detail it will be clear that customer relating control data are generated as to identification and bank account to satisfy requirements imposed by the supplier. Consequently the PU 20 will have connections with data banks concerning the customer data. So, if the requirements cannot be satisfied the procedure will be aborted.

The same can be true about the vehicle data. For example, if the fuel cap involved cannot be opened by means of the respective operating unit for unlocking the cap, the procedure will be aborted also. After approval of the data in order to start the fuel supply step the generated control data are read from the respective memory units and combined to a combined data acceptance signal by means of the PU 20. The signal includes combination of rear light position data and fuel cap position data in order to obtain cap position control data.

The combined data acceptance signal is sent to a robot arm control unit 35 via a link 35*a* in order to enable a robot arm to carry out the fuel supply step. Subsequently the robot arm will be moved to and connected with a fuel supply gate delivering the type of fuel requested. After having been connected, the robot arm is moved to the fuel cap. The fuel cap is opened by means of an unlocking device built in the nozzle end of the robot arm.

In a further advantageous embodiment, a two-step unlocking operation is carried out, a first step for opening an outer cap hinged and urged by a spring to its opened or closed position, and a second step for opening a mechanically or electromagnetically locked outer end of a vehicle tank fill pipe inlet. It will be clear that also the two-step arrangement data are included in the coded first data.

Thereafter a robot arm nozzle is inserted into the fill pipe, the position of which was also included in the coded data, and fuel supply is started. In particular, the fill pipe position data include the fill pipe position and fill pipe inlet direction relative to the cap position.

In a further embodiment of the present invention, further LED's on the robot arm nozzle will enable robot arm position and orientation control. Thus accurate positioning of the robot arm is obtained; moreover mechanically flexible robot constructions such as advanced robot hands can be applied.

Furthermore, the LED's arranged upon the robot arm can be used as the reference points as discussed above with respect to the position determination method.

3. Finishing Step:

Referring again to FIG. 2, in one embodiment a sensor 36 arranged upon the robot arm nozzle and activated during refuelling by a signal link 36*a* detects that the tank has been filled up, and generates a detection signal 36*b* which is directed to the PU 20 which in turn continues data processing in that the robot arm will be moved back to its starting position. In another embodiment, dependent on the facilities arranged in the vehicle, an interruption signal for finishing the fuel supply step is generated by the customer, and subsequently transmitted to the PU 20, processed by the PU, and sent to the robot control unit 35 to stop the fuel supply step. According to the control signal the robot arm is moved back to its starting position. In both alternatives a reversed fuel cap handling procedure is followed.

As a last event in finishing the refuelling procedure the customer has to be informed that he is ready for departure. Again dependent on the facilities present in the vehicle, in one embodiment on a display of the in-car terminal the above information is presented, whereas in another embodiment for example, a light signal or an acoustic signal is observed by the customer.

Now referring to FIG. 4 a flow chart of an embodiment of an operating sequence to be effected by the system of the invention is shown.

In the FIG. 4 steps (a) to (k) are distinguished. The steps mainly correspond with the procedures carried out by the system as explained above.

In step (a) the start request is presented. The customer has to start the procedure as mentioned above after having parked the vehicle alongside the fuel dispenser unit. Besides the above in a further embodiment, a parking detecting and parking control procedure can be provided in order to park at the right place thereby assuring that the robot arm can reach the fuel cap.

In steps (b) and (c) respectively the above mentioned second and first data signals are processed in order to generate a combined data acceptance signal for further control of the robot arm and starting the fuel supply step of the refuelling procedure. In the figure further indications are not shown as to the 3D-position determination. Details for the case where no acceptance signal can be generated is also not shown. Only the possibility for finishing the procedure is shown, but for those skilled in the art it will be clear that alternative steps after interruption may be chosen for such a flow chart.

In steps (d), (e) and (f) fuel is supplied by means of the robot arm operation as explained above.

In step (g) finishing or interruption of the refuelling procedure is presented whereas in step (h) a further check on the procedure is carried out.

In steps (i) and (j) finishing the refuelling procedure is carried out in accordance with the data supplied. Corrections or modifications can be carried out by going for step (k), being a restarting operation.

In a further advantageous embodiment of the system of the present invention the communication means communicates further refuelling procedure data. In particular such data relates to the amount of fuel to be supplied, or the money equivalent for which fuel is desired, can be transmitted as coded data also.

In the sequence and system shown above the refuelling procedure is carried out fully automatically. However, if certain facilities are not present, for example, in the case of introduction of the fully automatic system, the system is capable to be used for the part already implemented. Correspondingly only part of the data is used then, for example, only the first data signals for guiding the robot operations. Generally, for such cases system and sequence include slight modifications required for such conditions.

In accordance with the invention electronic circuitry for holding the above-mentioned data and to be used for communication to the above system is provided also. The invention furthermore provides a fuel dispenser unit coupled to the above system.

Various modifications of the present invention will become apparent to those skilled in the art from the foregoing description and accompanying drawings. For example, a combination of communication by means of the rear light LED and a freely movable and hand-operated service panel for IR communication is covered also. At least position determination has to be carried out with fixed points, i.e., for example, the rear light LED. Such modifications are intended to fall within the scope of the appended claims.

Advantages of the invention are (1) obtaining a fully integrated system for control of automatic refuelling automotive vehicles in that simultaneously full control of the refuelling procedure from inside the vehicle is maintained; (2) obtaining a system wherein the way of operating, i.e. the way of starting, monitoring, and finishing a refuelling procedure, is simplified substantially; (3) obtaining a system for automatic refuelling automotive vehicles wherein the client's active interaction can be reduced to a "single push on button" operation; and (4) obtaining such a system wherein the number of communication links is reduced substantially.

What is claimed is:

1. A system for control of automatic refueling of automotive vehicles parked alongside a fuel dispenser unit, the system comprising:

(a) a communication means for starting, monitoring and finishing a refueling procedure, said refuelling procedure including a starting step, a fuel supply step and a finishing step, the communications means being arranged within a vehicle to be refueled such that during the refuelling procedure the communications means is functional to control the refuelling procedure, the communications means also being functional to stop the fuel supply step by transmitting from the vehicle an interruption data signal;

(b) operating control units for controlling operating functions involved within said refuelling procedure, the operating functions being carried out by respective operating units having the capability of performing the operating functions on vehicle fuel systems which have different refuelling configurations;

(c) a processing unit for processing data signals from the vehicle and directing the processed data signals to and from said operating control units which control said respective operating units in executing the refuelling procedure;

(d) wherein the data signals comprise first and second data signals, said first data signals comprising fill pipe data, fuel cap position data, fuel type data and cap lock data, and said second data signals comprising customer identification data and customer bank account data; and (e) wherein the starting step includes processing the first and second data signals to determine whether the operating units are compatible with the vehicle's fill pipe, fuel cap position, fuel type and cap lock such that the operating units can refuel the vehicle and whether automatic payment can be made for the fuel, should the starting step determine that the operating units are capable of refuelling the vehicle and payment can automatically be made, the starting step approves the starting of the fuel supply step, otherwise the starting step aborts the refuelling procedure;

(f) wherein the communication means includes a transmitter/receiver means for transmitting and receiving signals, the transmitter/receiver means being located on the fuel dispenser unit and also being arranged within a rear light unit of the vehicle and wherein said fill pipe data signals, said fuel cap position data signals, said fuel type data signals, and said cap lock data signals are transmitted by the transmitter/receiver means on the vehicle and received by the transmitter/receiver means on the fuel dispenser unit.

2. The system as claimed in claim 1, wherein said communication means is operated continuously.

3. The system as claimed in claim 2, wherein said continuously operated communication means includes a vehicle control means for starting and finishing the refueling procedure by using at least one operating device which is engaged for starting the procedure and then respectively released for finishing the procedure.

4. The system as claimed in claim 3, wherein said vehicle control means comprise at least one pedal, operated for starting, respectively finishing, said refuelling procedure by pressing, respectively releasing, said pedal.

5. The system as claimed in claim 4, wherein a combination of pedals is used.

6. The system as claimed in claim 2, wherein said continuously operated communication means includes an in-car terminal having at least one key which is operated for starting, respectively finishing, said refuelling procedure by pressing, respectively releasing said key.

7. The system as claimed in claim 6, wherein a combination of pedals and keys is used.

8. The system as claimed in claim 6, wherein said transmitter/receiver means comprise electromagnetic wave transmitter/receiver means for receiving and transmitting electromagnetic waves.

9. The system as claimed in claim 8, wherein said transmitter/receiver means is functional to transmit and receive infra-red light waves.

10. The system as claimed in claim 9, wherein said transmitter/receiver means includes light emitting diodes for transmitters and semi-conductor infra-red receivers.

11. The system as claimed in claim 1, wherein said transmitter/receiver means comprise acoustic wave transmitter/receiver means for receiving and transmitting acoustic waves.

12. The system as claimed in claim 1, wherein said communication means comprise electronic circuitry holding said data signals to be communicated.

13. The system as claimed in claim 1, wherein the transmitter/receiver means for transmitting and receiving signals is an infra-red electromagnetic transmitter/-receiver means for transmitting and receiving infra-red light waves where the signals are conducted to the processing unit in order to determine respectively, the fill pipe position relative to the fuel cap, the fuel cap position relative to the rear light unit, the type of fuel to be refuelled, and the lock of the cap to be opened and locked respectively before and after the refuelling procedure, subsequently generating fill pipe position data, fuel cap position data, cap lock control data, and fuel type control data, and wherein said second data signals are processed in the processing unit in order to generate customer identification control data and customer bank account control data, the corresponding data signals being sent to a memory unit of said processing unit to be stored.

14. The system as claimed in claim 13, wherein at least said second data signals are displayed on an in-car terminal which further enables identification confirmation and fuel supply interrogation, interruption, continuation and finishing.

15. The system as claimed in claim 13, wherein during the starting step subsequently the fuel cap position data, the cap lock control data, the fill pipe position data, the fuel type control data, the customer identification control data, and the customer bank account control data are read from their respective processing unit memory units, and are processed by said processing unit in order to generate, after approval, a combined data acceptance signal comprising combined refuelling procedure data.

16. The system as claimed in claim 15, wherein said combined data acceptance signal generated is directed to a robot arm control unit in order to enable a robot arm to carry out the fuel supply step.

* * * * *